US008985051B2

(12) United States Patent
Crawford

(10) Patent No.: US 8,985,051 B2
(45) Date of Patent: Mar. 24, 2015

(54) APPARATUS FOR PRODUCING A SPRAY OF CHANGED DROPLETS OF AQUEOUS LIQUID

(75) Inventor: Jonathan Crawford, Vancouver (CA)

(73) Assignee: Honeywell ASCa Inc., Mississauga (CA)

( * ) Notice: Subject to any disclaimer, the term of this patent is extended or adjusted under 35 U.S.C. 154(b) by 226 days.

(21) Appl. No.: 13/326,602

(22) Filed: Dec. 15, 2011

(65) Prior Publication Data

US 2013/0156970 A1 Jun. 20, 2013

(51) Int. Cl.

| | |
|---|---|
| ***B05B 5/00*** | (2006.01) |
| ***B05B 5/08*** | (2006.01) |
| ***B05B 5/025*** | (2006.01) |
| ***B05B 5/043*** | (2006.01) |
| ***B05D 1/04*** | (2006.01) |
| ***B05B 7/06*** | (2006.01) |
| ***B05B 5/053*** | (2006.01) |
| ***B05B 5/16*** | (2006.01) |
| ***B05D 5/00*** | (2006.01) |
| ***B05C 11/00*** | (2006.01) |
| ***B05B 5/035*** | (2006.01) |
| ***D21H 23/50*** | (2006.01) |
| ***D21H 19/00*** | (2006.01) |
| *B05B 5/14* | (2006.01) |

(52) U.S. Cl.

CPC . *B05B 5/00* (2013.01); *B05B 7/061* (2013.01); *B05B 5/0536* (2013.01); *B05B 5/1608* (2013.01); *B05B 5/025* (2013.01); *B05D 5/00* (2013.01); *B05C 11/00* (2013.01); *B05D 1/04* (2013.01); *B05B 5/043* (2013.01); *B05B 5/035* (2013.01); *B05B 5/0533* (2013.01); *B05B 5/082* (2013.01); *B05B 5/087* (2013.01); *B05B 5/14* (2013.01); *D21H 23/50* (2013.01); *D21H 19/00* (2013.01)

USPC ..... 118/621; 118/627; 118/624; 118/313; 118/320; 118/322; 118/324; 118/325; 239/698; 239/704; 239/690.1; 239/708; 427/483; 361/227

(58) Field of Classification Search

USPC ..... 427/469; 118/620–639, 325, 255–263; 239/690, 696, 697–698, 706–708

See application file for complete search history.

(56) References Cited

U.S. PATENT DOCUMENTS

| | | | | | |
|---|---|---|---|---|---|
| 2,890,388 | A | * | 6/1959 | Croskey et al. | 118/630 |
| 3,152,918 | A | * | 10/1964 | Kraus | 118/304 |
| 3,900,000 | A | * | 8/1975 | Gallen | 118/630 |
| 3,911,448 | A | * | 10/1975 | Ohno et al. | 347/3 |
| 3,968,498 | A | * | 7/1976 | Uchiyama | 118/663 |
| 4,009,829 | A | | 3/1977 | Sickles | |

(Continued)

FOREIGN PATENT DOCUMENTS

| | | | | |
|---|---|---|---|---|
| JP | 2004122091 | A | * | 4/2004 |
| JP | 2006021148 | A | * | 1/2006 |

*Primary Examiner* — Dah-Wei D Yuan
*Assistant Examiner* — Binu Thomas
(74) *Attorney, Agent, or Firm* — Cascio Schmeyer & Zervas

(57) ABSTRACT

A coating apparatus produces a spray of charged droplets and controls the spray angle of travel of the spray toward the object to be coated. Electrically charging droplets minimizes the amount of coating material required to uniformly coat a surface as compared to conventional web coating techniques such as blade coating. An inductive ring guides the spray charged droplets as they exit the nozzle of a spray device. The electrostatic repulsion between the charged droplets insures that a uniform coating of liquid formulation can be applied to a web surface.

10 Claims, 2 Drawing Sheets

(56) References Cited

U.S. PATENT DOCUMENTS

| | | | | | |
|---|---|---|---|---|---|
| 4,215,818 | A | | 8/1980 | Hopkinson | |
| 4,240,585 | A | | 12/1980 | Sickles | |
| 4,281,333 | A | * | 7/1981 | Tsuzuki et al. | 347/15 |
| 4,383,767 | A | * | 5/1983 | Jido | 366/154.1 |
| 4,489,894 | A | * | 12/1984 | Marchant et al. | 239/693 |
| 4,829,996 | A | | 5/1989 | Noakes | |
| 4,887,770 | A | * | 12/1989 | Wacker et al. | 239/703 |
| 5,045,342 | A | | 9/1991 | Boissevain | |
| RE33,741 | E | | 11/1991 | Boissevain | |
| 5,065,673 | A | | 11/1991 | Taylor | |
| 5,086,972 | A | * | 2/1992 | Chang et al. | 239/3 |
| 5,154,358 | A | * | 10/1992 | Hartle | 239/697 |
| 5,163,365 | A | | 11/1992 | Taylor | |
| 5,520,715 | A | * | 5/1996 | Oeftering | 347/1 |
| 5,527,564 | A | | 6/1996 | Napadow | |
| 5,765,761 | A | * | 6/1998 | Law et al. | 239/690.1 |
| 5,948,183 | A | * | 9/1999 | Okada et al. | 148/330 |
| 5,948,483 | A | * | 9/1999 | Kim et al. | 427/483 |
| 6,074,483 | A | | 6/2000 | Belotserkovsky | |
| 6,211,477 | B1 | | 4/2001 | Cardott | |
| 6,248,407 | B1 | * | 6/2001 | Hess | 239/419.3 |
| 6,334,579 | B1 | | 1/2002 | Zarbi | |
| 6,353,271 | B1 | | 3/2002 | Williams | |
| 6,494,954 | B1 | * | 12/2002 | Bernert et al. | 118/314 |
| 6,623,112 | B2 | * | 9/2003 | Yamada et al. | 347/74 |
| 6,684,879 | B1 | * | 2/2004 | Coffee et al. | 128/200.14 |
| 6,764,720 | B2 | * | 7/2004 | Pui et al. | 427/479 |
| 7,494,567 | B2 | | 2/2009 | Haran | |
| 7,972,658 | B2 | | 7/2011 | Kukkurainen | |
| 2004/0050946 | A1 | * | 3/2004 | Wang et al. | 239/3 |
| 2006/0110544 | A1 | * | 5/2006 | Kim et al. | 427/458 |
| 2007/0194157 | A1 | * | 8/2007 | Golden et al. | 239/690 |
| 2008/0273061 | A1 | * | 11/2008 | Tsuchiya et al. | 347/55 |

* cited by examiner

APPARATUS FOR PRODUCING A SPRAY OF CHANGED DROPLETS OF AQUEOUS LIQUID

FIELD OF THE INVENTION

The present invention generally relates to techniques for controlling the amount of a coating that is applied on paper sheet or other web products, and in particular to a device that generates charged coating droplets that are sprayed in a controlled manner onto the web to create a uniform distribution of the coating.

BACKGROUND OF THE INVENTION

In the process of papermaking, it is often desirable to coat a paper sheet (called a "base sheet") with any of a wide variety of materials. Indeed, an increasing proportion of the world's paper production is devoted to coated paper and coated paperboard. Coatings are usually applied to provide a glossy white surface for magazine pages, gift-wrapping, shoeboxes, and the like. Alternatively, or in addition, such coatings may also be intended to render the paper sheet waterproof. As another example of a coating material, microencapsulated ink may be applied as a coating to one side of a sheet of carbonless copy paper.

Coatings may be applied to paper as part of the papermaking process in a paper mill. Alternatively, previously manufactured paper may be supplied to the coating machine, called a "coater", from large rolls of paper sheet. In either event, the uncoated paper is usually supplied to the coater in sheets that are on the order of 3 meter or more in width measured along the "cross-direction" (i.e., the direction transverse to the direction of movement of the paper along the papermaking and/or coating machine).

Uniformity of coating "basis weight" the mass of the coating material on a unit of surface area of the sheet) is often necessary or desirable for various reasons. For example, the printability of glossy paper may be improved by the uniform application of a gloss coating. Also, gloss coatings may contain relatively expensive materials, such as latex and/or $TiO_2$. Accordingly, the manufacturer will want to precisely monitor the coating and control the application of such coating to apply as uniform a coating as possible. In some cases, the evenness of the coating must be controlled within a fraction of a gram/$m^2$. However, because of the lateral extent of the sheet in the cross-direction (3 meters or more) and the requirement of accurately and evenly applying a coating to such sheets, rather complex coaters have been designed and manufactured.

Coaters come in a variety of configurations. One type of coater, called a "blade coater", comprises a rotating backing drum disposed adjacent to one side of a moving paper sheet and a flexible blade disposed adjacent to the opposite side of the sheet. The drum and blade edge extend in the cross-direction of the sheet to form a narrow slot through which the sheet of paper passes. A pool of coating material is retained between the backing drum and the blade, and thus coats the sheet as it passes therebetween. The blade presses against the paper with the coating applied as the sheet exits through the slot, thereby removing excess coating.

It will be appreciated that the separation of the drum from the blade edge is a critical factor in the application of such coatings. The drum is fabricated and installed to high tolerances. To control the thickness of the coating applied to a sheet, coaters provide actuators for adjusting the pressure of the blade edge against the coated sheet, and/or the position of the blade edge relative to the drum. The blade is usually made of a thin steel member that may be slightly bent or flexed. Thus, actuators are installed at intervals alone the length of the blade, such that each actuator controls the pressure applied by the blade in the vicinity of the actuator, and therefore, the amount of coating material on the base sheet. The cross-directional length of the blade in the vicinity of each actuator is known as a "slice". Local variations in blade pressure and paper thickness, and other factors tend to produce uneven coatings. Even distribution of coating on paper and other web coating applications is difficult to achieve. Often, in order to form uniform coatings, excessive coating (or over spray) or non-ideal coating distribution must be applied.

SUMMARY OF THE INVENTION

The present invention is based, in part, on the recognition that electrically charging droplets in a spray in a coating process will minimize the amount of coating material required to uniformly coat a surface as compared to conventional web coating techniques such as blade coating. The invention provides a method of controlling the droplet size; moreover, the equally charged droplets that are generated exert electrostatic repulsive forces which facilitate their uniform distribution and in the process of being directed toward the surface of a web, the droplets will adhere to the surface of the web and the resulting coating will exhibit the required pattern over a web surface. While the invention will be illustrated with respect to coating paper, it is understood that the device can be employed to coat any object, and web products in particular, where uniform distribution of the coating is required.

In one aspect, the invention is directed to an apparatus for producing a spray of charged droplets of a liquid that includes:

(a) a source of the liquid;
(b) means for atomizing the liquid to produce a spray of droplets;
(c) means for controlling the flow of the liquid through the atomizing means;
(d) means for imparting a charge on the liquid and/or the spray of droplets; and
(e) means for controlling the spray angle of travel of the spray of charged droplets.

In another aspect, the invention is directed to an apparatus for coating a web that is moving in the machine direction that includes:

(a) one or more spray devices that are positioned adjacent to a surface of the web along a cross direction to the web wherein each spray device produces a spray of charged droplets of a liquid directed at the surface, wherein each device includes
(i) means for atomizing the liquid to produce a spray of droplets;
(ii) means for imparting a charge on the liquid and/or the spray of droplets; and
(iii) means for controlling the spray angle of travel of the spray of charged droplets; and
(b) a source of liquid that supplies liquid to the spray devices.

In a further aspect, the invention is directed to a method of distributing a liquid along the length of a moving web that is guided by a continuous rotatable roll that includes the steps of:

(a) generating a spray containing charged droplets of the liquid;

(b) directing the spray onto a surface of the moving web; and (c) maneuvering the direction of the spray to distribute the droplets in a desired pattern on the surface along the length of the moving web.

DESCRIPTION PREFERRED EMBODIMENTS

Figure 1:
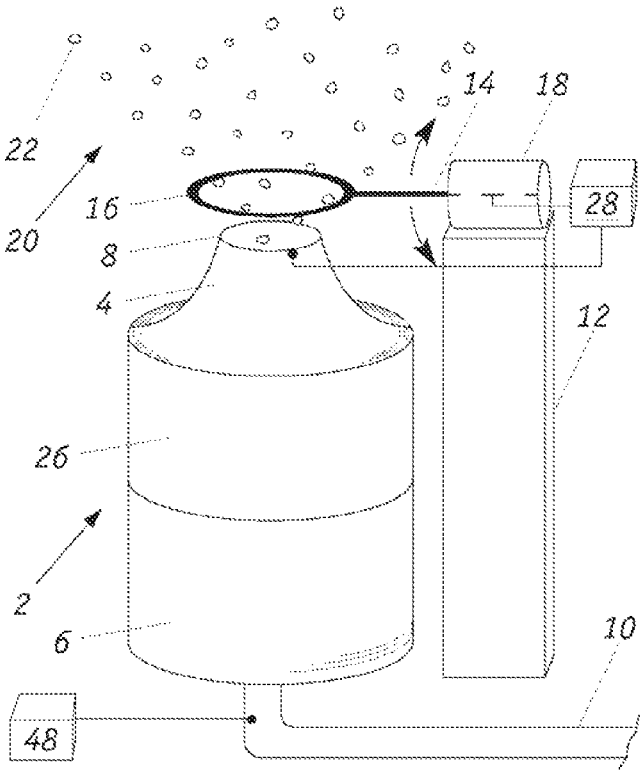
FIG. 1 depicts a nozzle device for generating a spray of charged droplets.

FIG. 1 shows an embodiment of a spray apparatus 2 for producing a spray 20 of charged droplets 22 of a liquid that is to be uniformly distributed onto a surface to be coated. Apparatus 2 includes a spray mechanism 4 that is equipped with nozzle 8 having an aperture through which a spray 20 of charged or non-charged droplets 22 is continuously emitted. Suitable spray devices and nozzles that atomize liquids by air or hydraulic pressure into droplets are described, for example, in U.S. Pat. Nos. 4,215,818 to Hopkinson, U.S. Pat. No. 4,887,770 to Wacker et al. and U.S. Pat. No. 6,334,579 to Zarbi, which are incorporated herein by reference.

The outer contour of spray 20 is preferably cone-shaped with the individual droplets 22 being evenly distributed within the inner region of the cone. Because the droplets 22 are electrically charged at the same polarity they will repel each other. It is understood that the shape of spray 20 can be modified as desired depending on how the liquid coating is to he applied. For instance, the spray can be generated as a linear jet stream, a two-dimensional fan, or other arrangement by changing the nozzle aperture configuration.

The liquid to be sprayed is supplied via channel 10 to the spray device where the liquid flow rate can be regulated by conventional means including pressure controller 6 and flow regulator valve 26. One method of forming electrically charged droplets 22 is by charging the liquid by conduction prior to its being delivered to spray mechanism 4. For example, as shown in FIG. 1, a d.c. voltage generator 48 applies an electrical potential to the liquid prior to being atomized. In this fashion, aperture 8 emits a spray 20 of electrically charged droplets 22. The size or diameter of the droplets is determined in part by the nozzle sizes in spray mechanism 4 and the level of air or hydraulic pressure employed with smaller droplets being generated at higher pressures. When the spray medium is water the majority of the droplets will preferably range from 15 to 50 microns in size. The droplet size will also depend on the material properties of the fluid being atomized.

Alternatively, the spray mechanism 4 can be configured to emit a spray 4 of non-charged droplets 22 that are subsequently charged by induction. In a preferred embodiment as illustrated in FIG. 1, an inductive element (or electrode) 14 which has a metal annular or ring-shaped distal portion 16 is positioned adjacent nozzle 8 so that the spray of droplets traverses through the ring. The inductive element 14 and the metallic lip that forms aperture 8 are connected to a d.c. voltage potential generator 28 so that as non-charged droplets are emitted from aperture 8, the droplets develop an electrical charge as they are exposed to the electric field produced in the gap between the lip and the inductive element 14. The size of droplets 22 in this case is also influenced by the electric field strength with smaller sizes being produced at higher strengths.

The inductive element 14 also serves to control the spray angle so that the droplets 22 can be directed toward different directions as desired. In this regard, a drive mechanism 18, that maneuvers inductive element 14 and which is supported on platform 12, can comprise servomotors, linear or electromagnetic actuators. The inductive element's potential has a polarity that is either equal to or opposite that of the discharged droplets. As is apparent, this spray angle control mechanism can also be used to change the angle of spray 20 even in the configuration where the charged droplets are generated from charged liquids. The spray angle mechanism can also be moved linearly in the direction of the spray flow to change the proximity of the inductive ring to the spray droplets. In each case, the inductive element 14 allows spray patterns to be manipulated as desired. This can be accomplished, for instance, by tilting the position of inductive element 14 and thereby alter the spray angle: In addition, the current through inductive element 14 can be increased or decreased to change the electric field strength. When the inductive element is at the same polarity as that of the charged droplets, the higher current will cause greater repulsion of the charged droplet particles and result in a smaller cone shaped spray. This method works with any form of atomized spray that is charged by induction or conduction.

Figure 2:
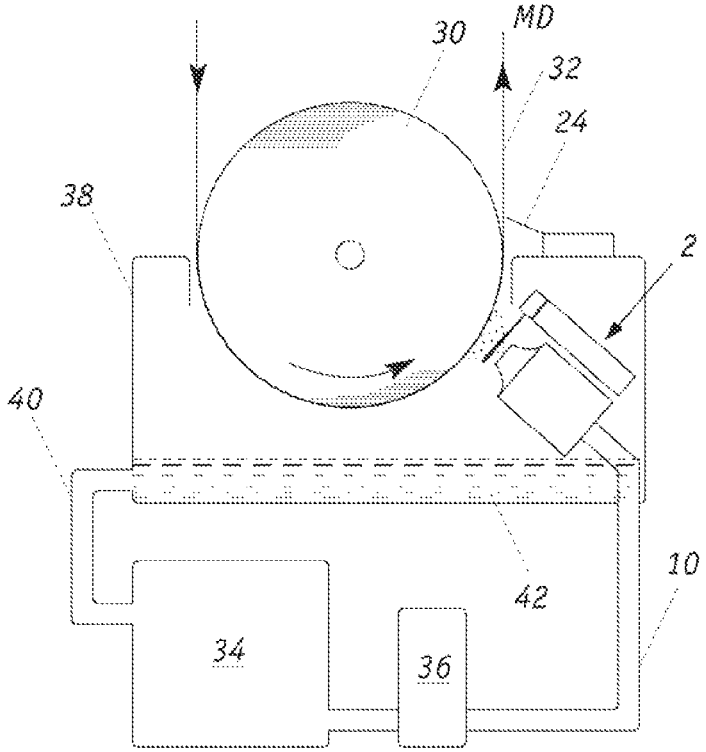
FIGS. 2 and 3 illustrate a system for coating webs with a plurality of spray devices amounted adjacent a rotatable roller supported a web.

FIG. 2 shows the positioning of spray apparatus 2 adjacent to a web 32 that is supported and guided by rotatable roller 30 as web 32 moves in the machine direction (MD). The spray apparatus 2 is situated within the interior of housing 38 that defines a chamber into which excess liquid coating 42 is collected and recycled via channel 40 back into a liquid source 34 for reused. During operation, pump 36 continuous delivers a liquid via channel 10 into the spray apparatus 2 that distributes a pattern of the coating onto the surface of web 32. Optionally, a blade 24 is positioned downstream of spray apparatus 2 to remove excess coating from the web surface.

Figure 3:
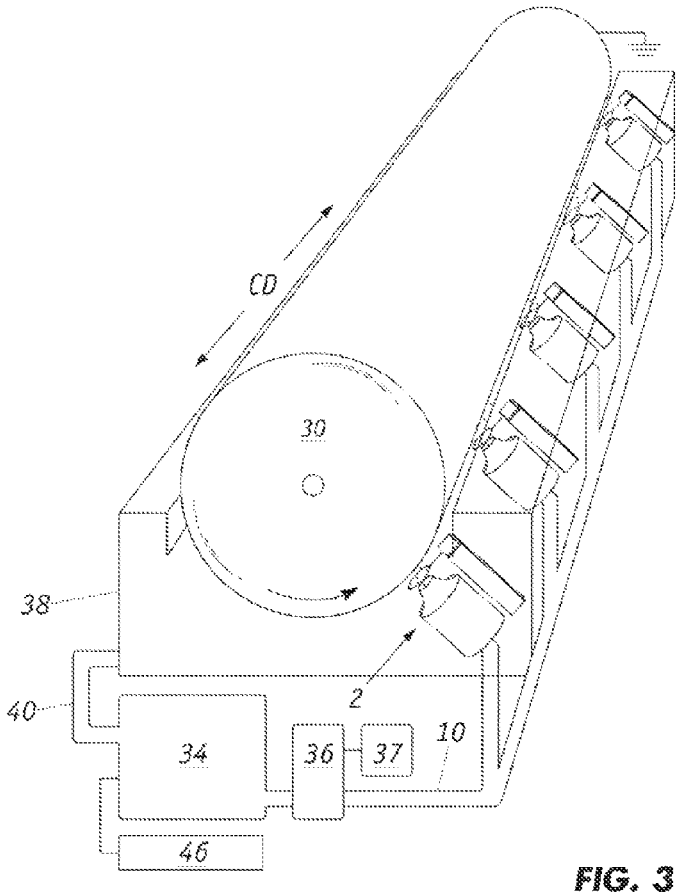

FIG. 3 shows a plurality of spray apparatuses 2 that are positioned along the cross direction (CD) adjacent roller 30 and that directs a corresponding set of spray overlapping patterns toward the roller. As the web (not shown) travels pass the plurality of spray apparatuses 2, a coating having the desired pattern is formed on the surface. Typically, the pattern will be a uniform distribution of the coating along the cross direction although the spray apparatuses can be configured to distribute specific patterns as desired. A liquid from source 34 is supplied by pump 36 via channel 10 to the plurality of spray apparatuses 2. In this arrangement, a source of d.c. voltage generator 46 is connected to source 34 liquid so that the droplets are charged as they exit each spray apparatus. Alternatively, the electric potential in the form of a d.c. voltage generator 37 can be connected to pump 36 or other suitable device in the liquid flow process. It is critical that the charged liquid from source 34 be electrically isolated from the rest of the system as the liquid is pumped to the spray apparatuses 2. The rotatable roller 30 can be grounded so that the charged droplet particles will not he expelled from the web surface.

The spray apparatus 2 can be employed to spray any suitable liquid based formulation that will form droplets that can maintain a stable electric charge. Preferred formulations are electrically conductive and preferably comprise water or aqueous solutions and mixtures. For paper applications, water is often applied at different stages of the papermaking process. In addition, there is a large variety of coating formulations, many of which consist of as many as ten or more components. These components can be broadly classified as pigments, binders, and additives, almost always as aqueous dispersions. Various formulations of latexes are used for binders to hold the pigment particles together and to bond them to the paper. A typical coating formulation includes 80% to 90% pigment, 3% to 10% latex, with the remainder consisting of additives or other components.

Figure 4:
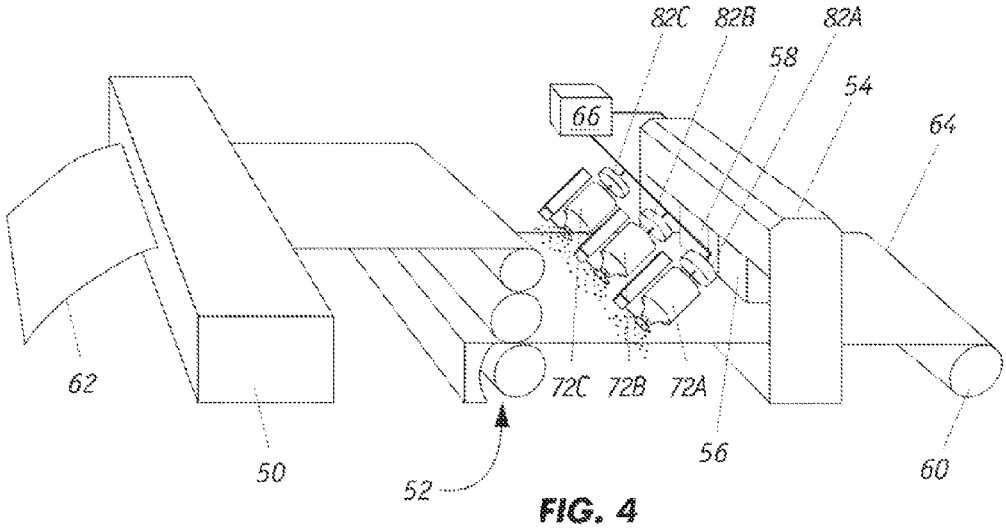
FIG. 4 illustrates a coating process at the dry end of a papermaking machine with cross directional monitoring of the coating profile.

As shown in FIG. 4, typical industrial papermaking machines include a "wet end" or "forming" portion that transforms wet stock into a partially dried sheet of paper 62 that proceeds into a dryer 50. From the dryer, the paper continues downstream into the "dry end" that includes, among operations, a calendaring stack 52 and reel 60. A plurality of spray apparatuses 72A, 72B and 72C, that are regulated by corresponding actuators 82A, 82B and 82C, respectively, is positioned along the cross direction in an unsupported region between the calendaring stack 52 and reel 60 and coats the upper surface of the paper as it passes by. A scanning sensor, that includes an optical source 56 and an optical detector 58, which is supported on supporting frame 54, continuously traverses the sheet and measures properties of finished coated sheet 64 in the cross-direction. Multiple stationary sensors could also be used. Scanning sensors are known in the art and are described, for example, in U.S. Pat. Nos. 6,074,483 to Belotserkovsky et al., and U.S. Pat. No. 7,494,567 to Haran, which are incorporated herein by reference. The finished sheet product 64 is then collected on reel 60.

Actuators 82A, 82B and 82C control the distribution of the coating along the cross direction. Measured data from sensors 56, 58 are communicated to controller 66 that calculates control actions for the actuators in order to minimize the variation of the measured properties data from a desired target. For example, if the measured CD coating profile deviates from a target, appropriate control actions are communicated to at least one of the actuators to changes its spray angle, droplet size, droplet volume and/or other parameters.

The foregoing has described the principles, preferred embodiments and modes of operation of the present invention. However, the invention should not be construed as being limited to the particular embodiments discussed. Thus, the above-described embodiments should be regarded as illustrative rather than as restrictive, and it should be appreciated that variations can be made in those embodiments by workers skilled in the art without departing from the scope of the present invention as defined by the following claims.

What is claimed is:

1. An apparatus that produces a spray of charged droplets of an aqueous liquid that comprises:

(a) a reservoir containing the aqueous liquid;

(b) a spray device that atomizes the aqueous liquid, that is pumped from the reservoir at a liquid flow rate that is regulated by a pressure controller, into a spray of droplets which exits a spray nozzle of the spray device at a spray angle of travel;

(c) a d.c. voltage generator that is connected to the aqueous liquid in the reservoir to impart an electrical charge to the aqueous liquid so as to generate a charged aqueous liquid that is supplied to the spray device such that the spray of droplets which exits the spray nozzle contains charged droplets that are charged at the same polarity;

(d) means for controlling flow of the charged aqueous liquid from the reservoir to the spray device wherein the charged aqueous liquid is electrically isolated from the spray device;

(e) an inductive element disposed at a location traversed by the spray of droplets and a first potential source that applies a first electrical potential to the inductive element wherein the first potential has a polarity that is either equal to or opposite that of the charged droplets wherein the inductive element has a ring-shaped distal portion that defines an aperture through which the spray of droplets travels;

(f) means for changing a level of current flowing through the inductive element in order to change the spray angle of travel of the charged droplets exiting the spray nozzle; and (g) means for moving the inductive element configured to change the spray angle of travel of the charged droplets exiting the spray nozzle which is spaced apart from the ring-shaped distal portion.

2. The apparatus of claim 1 wherein the means for moving the inductive element comprises a drive mechanism that tilts the inductive-element in order to change the spray angle of travel of the charged droplets exiting the spray nozzle.

3. An apparatus that produces a spray of charged droplets of an aqueous liquid that comprises:

(a) a source of the aqueous liquid;

(b) a spray device that atomizes the aqueous liquid, that is pumped from the source at a liquid flow rate that is regulated by a pressure controller a spray of electrically non-charged droplets which exits a spray nozzle of the spray device at a spray angle of travel;

(c) means for controlling flow of the aqueous liquid from the source to the spray device;

(d) an inductive element disposed at a location traversed by the spray of electrically non-charged droplets;

(e) a d.c. voltage potential source that applies an electrical potential to the inductive element so that an electrical field is produced in a gap between the spray nozzle and inductive element such that non-charged droplets that exit the spray nozzle develop an electrical charge as the non-charged droplets are exposed to the electric field to form a spray of charged droplets that travel at the spray angle wherein the inductive element has a ring-shaped distal portion that defines an aperture through which the spray of charged droplets travels;

(g) means for changing a level of current flowing through the inductive element in order to change the spray angle of travel of the charged droplets; and (h) a drive mechanism configured to tilt the inductive element to change the spray angle of travel of the charged droplets.

4. The apparatus of claim 3 wherein the spray nozzle has a metallic lip and the electric field is produced between the metallic lip and the inductive element.

5. An apparatus that produces a spray of charged droplets of an aqueous liquid that comprises:

(a) a source of the aqueous liquid;

(b) a spray device that atomizes the aqueous liquid, that is pumped from the source at a liquid flow rate that is regulated by a pressure controller a spray of droplets which exits a spray nozzle of the spray device at a spray angle of travel;

(c) a conduit situated between the source and the spray device through which the aqueous liquid flows wherein the aqueous liquid in the conduit is electrically isolated from the spray device;

(d) a d.c. voltage generator that is connected to the conduit to impart an electrical charge to the aqueous liquid so as to generate a charged aqueous liquid that is supplied to the spray device such that the spray of droplets which exits the spray nozzle contains charged droplets that are charged at the same polarity;

(e) an inductive element disposed at a location traversed by the spray of droplets and a potential source that applies an electrical potential to the inductive element wherein the potential has a polarity that is either equal to or opposite that of the charged droplets wherein the inductive element has a ring-shaped distal portion that defines an aperture through which the spray of droplets travels;

(f) means for changing a level of current flow through the inductive element in order to change the spray angle of travel of the charged droplets; and (g) means for moving the inductive element configured to change the spray angle of travel of the charged droplets.

6. The apparatus of claim 5 the conduit includes a pump and the d.c. voltage generator is connected to the pump.

7. The apparatus of claim 5 wherein the means for moving the inductive element comprises a drive mechanism that tilts the inductive element in order to change the spray angle of travel of the charged droplets exiting the spray nozzle.

8. An apparatus for coating a web that is moving in a machine direction wherein the web is supported on a rotatable roll that comprises:

(a) a reservoir containing an aqueous liquid;

(b) a plurality of spray devices positioned adjacent to a surface of the web along a cross direction to the web wherein the aqueous liquid is pumped from the reservoir to the plurality of spray devices at a liquid flow rate that is regulated by a pressure controller and wherein each spray device includes: (i) a nozzle that atomizes aqueous liquid into a spray of droplets which exits the nozzle at a spray angle of travel, (ii) an inductive element disposed at a location traversed by the spray of droplets wherein the inductive element has a ring-shaped distal portion that defines an aperture through which the spray of droplets travels, (iii) means for changing a level of current flowing through the inductive element in order to change the spray angle of travel of a spray of droplets exiting the nozzle and (iv) a drive mechanism configured to tilt the ring-shaped distal portion to change the spray angle of travel of the droplets exiting an associated nozzle;

(c) a d.c. voltage generator that is connected to the aqueous liquid in the reservoir to impart an electrical charge to the aqueous liquid so as to generate a charged aqueous liquid that is supplied to each spray device such that the spray of droplets which exits each nozzle contains charged droplets that are charged at the same polarity;

(d) a potential source that applies an electrical potential to the conductive element of each spray device wherein the potential has a polarity that is either equal to or opposite that of the charged droplets; and (e) means for controlling flow of the charged aqueous liquid from the reservoir to the plurality of spray devices wherein the charged aqueous liquid is electrically isolated from the plurality of spray devices.

9. An apparatus for coating a web that is moving in a machine direction wherein the web is supported on a rotatable roll that comprises:

(a) a plurality of spray devices positioned adjacent to a surface of the web along a cross direction to the web wherein each spray device includes: (i) a nozzle that atomizes aqueous liquid into a spray of droplets which exits the nozzle at a spray angle of travel such that the spray of droplets which exits the nozzle comprises electrically non-charged droplets of aqueous liquid, (ii) an inductive element disposed at a location traversed by the spray of droplets wherein the inductive element has a ring-shaped distal portion that defines an aperture through which the spray of droplets travels (iii) means for changing a level of current flowing through the inductive element in order to change the spray angle of travel of a spray of droplets exiting the nozzle; and (iv) a drive mechanism configured to tilt the inductive element to change the spray angle of travel of the droplets exiting the spray nozzle;

(b) a source of the aqueous liquid wherein the aqueous liquid is pumped from the source to the plurality of spray devices at a liquid flow rate that is regulated by a pressure controller and;

(c) means for controlling flow of aqueous liquid from the source to the plurality of spray devices; and (d) a d.c. voltage potential source that applies an electrical potential to each inductive element so that an electrical field is produced in a gap between each nozzle and associated inductive element such that non-charged droplets that exit each nozzle develop an electrical charge as the non-charged droplets are exposed to the electric field.

10. An apparatus for coating a web that is moving in a machine direction wherein the web is supported on a rotatable roll that comprises:

(a) a plurality of spray devices positioned adjacent to a surface of the web along a cross direction to the web wherein each spray device includes: (i) a nozzle atomizes the aqueous liquid into a spray of droplets which exits the nozzle at a spray angle of travel, (ii) an inductive element disposed at a location traversed by the spray of droplets,(iii) means for changing a level of current flow through the inductive element in order to change the spray angle of travel of a spray of droplets wherein the inductive element has a ring-shaped distal portion that defines an aperture through which the spray of droplets travels; and (iv) a drive mechanism configured to tilt the ring-shaped distal portion to change the spray angle of travel of the droplets exiting the nozzle;

(b) a source of the aqueous liquid wherein the aqueous liquid is pumped from the source to the plurality of spray devices at a liquid flow rate that is regulated by a pressure controller;

(c) a conduit situated between the source and plurality of spray devices through which the aqueous liquid flows wherein the aqueous liquid in the conduit is electrically isolated from the plurality of spray devices;

(d) a d.c. voltage generator that is connected to the conduit to impart an electrical charge on the aqueous liquid so as to generate a charged aqueous liquid that is supplied to the plurality of spray devices such that the spray of droplets which exits each nozzle contains charged droplets that are charged at the same polarity; and (e) a first potential source that applies a first electrical potential to each inductive element wherein the first potential has a polarity that is either equal to or opposite that of the charged droplets.

* * * * *

UNITED STATES PATENT AND TRADEMARK OFFICE

CERTIFICATE OF CORRECTION

PATENT NO. : 8,985,051 B2
APPLICATION NO. : 13/326602
DATED : March 24, 2015
INVENTOR(S) : Jonathan Crawford It is certified that error appears in the above-identified patent and that said Letters Patent is hereby corrected as shown below:

On the Title Page and in the Specification at column 1, line 2, in the title, "CHANGED" should be --CHARGED--.

Signed and Sealed this
Thirty-first Day of May, 2016

Michelle K. Lee

Michelle K. Lee
*Director of the United States Patent and Trademark Office*